US006109335A

United States Patent [19]

Jolivet et al.

[11] Patent Number: 6,109,335

[45] Date of Patent: Aug. 29, 2000

[54] INGOT MOULD FOR THE CONTINUOUS VERTICAL CASTING OF METALS

[75] Inventors: Jean-Marc Jolivet, Guenange; Eric Perrin, Metz, both of France

[73] Assignees: Ugine Savoie, Ugine; Sogepass, Amneville; Sollac; Ascometal, both of Puteaux, all of France; Societe Anonyme des Forges et Acieries, Dillingen/Sarre, Germany

[21] Appl. No.: 09/147,028

[22] PCT Filed: Mar. 27, 1997

[86] PCT No.: PCT/FR97/00546

§ 371 Date: Jan. 22, 1999

§ 102(e) Date: Jan. 22, 1999

[87] PCT Pub. No.: WO97/37792

PCT Pub. Date: Oct. 16, 1997

[30] Foreign Application Priority Data

Apr. 5, 1996 [FR] France ..... 96 04306

[51] Int. Cl.[7] ..... B22D 11/049

[52] U.S. Cl. ..... 164/444; 164/487

[58] Field of Search ..... 164/487, 444, 164/475, 415

[56] References Cited

U.S. PATENT DOCUMENTS 5,320,159 6/1994 Schneider et al. ..... 164/444

FOREIGN PATENT DOCUMENTS 0 218 855 4/1987 European Pat. Off. .
0 620 062 10/1994 European Pat. Off. .
2359662 2/1978 France .
57-799 5/1969 Luxembourg .

*Primary Examiner*—Kuang Y. Lin
*Attorney, Agent, or Firm*—Nixon & Peabody LLP; Thomas W. Cole

[57] ABSTRACT

This mold consists of a cooled mold body (1), made of copper or a copper alloy, on which sits a refractory feed head (2) and a purge slit (8) is made at the interface between said mold body and said feed head, via which a stream of a waste inert gas is injected around the internal perimeter of the mold. The slit is supplied via a plenum chamber (13) made within the mold, the plenum chamber being itself supplied with gas via inlets (12) which connect it to a pressurized-gas supply (20). The injection slit (8) is segmented around the mold perimeter with the aid of separating means (21) which also segment the plenum chamber into compartments (13', 13", etc.) which are juxtaposed around the perimeter of the mold so that an inlet (12) runs out into each compartment thus formed. Thus, a plurality of elementary circuits (12'-13"- 8'), which are mounted "in parallel" with respect to a single pressure chamber (20), are produced so that, overall, the injection of gas around the perimeter of the mold becomes insensitive to local perturbations such as local variations in the thickness of the slit.

6 Claims, 2 Drawing Sheets

(Section on B-B)

(Section on A-A)

INGOT MOULD FOR THE CONTINUOUS VERTICAL CASTING OF METALS

BACKGROUND OF THE INVENTION

The present invention relates to the vertical hot-top continuous casting of metals, especially steel.

DESCRIPTION OF THE PRIOR ART

It is known that vertical hot-top continuous casting is essentially distinguished from conventional vertical continuous casting by the fact that sitting on top of the cooled mold body (generally made of copper or a copper alloy), which ensures that the cast metal undergoes peripheral solidification, is a feed head made of a refractory material containing a reservoir of molten metal maintained in the liquid state (FR-A-2,000,365). In this manner, the point in the copper body where the cast metal starts to solidify is decoupled from the point where the free surface of the molten metal in the feed head lies, whereas they are virtually coincident in conventional vertical continuous casting.

The aim is thus to be able to cast products of good quality at high extraction rates, since the solidification region is no longer disturbed by the normal turbulence in the flow of metal arriving in the mold, this turbulence being confined to the buffer volume within the feed head.

It is also known to apply an inert-gas purge, for example an argon purge, by injecting waste gas into the interface between the mold body and the feed head. Such an arrangement is described, for example, in Patent Application EP-A-620,062 in the name of the Applicant. This purge is intended to break the film of inhomogeneous spurious solidification which tends to form when the molten metal comes into contact with the wall of the refractory feed head. This creates conditions favourable to a cast metal starting to solidify in a sharp and uniform manner always at the same point in the mold, namely level with the upper edge of the cooled metal body at the end of the feed head.

The aforementioned document describes an injection technology shown in the appended FIG. 1. This essentially involves an peripheral slit (8) which emerges at the internal periphery of the mold, this slit being continuous or segmented. Flowing along the purge slit (8) is a stream of waste argon from an annular plenum chamber (13) made near the slit and allowing an identical gas pressure to be maintained at every point around the perimeter in said chamber. Low-pressure-drop inlets (12) connect this chamber (13) to the gas supply consisting of a box (10) attached to the mold.

In this type of configuration, the main pressure drop in the flow of injected gas occurs at the purge slit (8) and is intimately associated with the geometry of the latter, more particularly with the thickness of the slit. Should the surfaces facing each other (the upper face of the cooled metal body (1) of the mold and the lower face of the refractory feed head (2)) not be strictly parallel, a local variation in the thickness of the slit then results in a heterogeneous argon injection rate around the perimeter of the mold and therefore to possible surface defects on the cast product. Such lack of parallelism between the two facing surfaces occurs in particular when the perimeter, or the cross section, of the cast product is large (slabs or large blooms) and when differential thermal expansion effects, between the various materials present, occur, more particularly near the corners of the mold (which practically always occurs after a few minutes of casting).

SUMMARY OF THE INVENTION

The object of the present invention is to ensure that the purge gas injection rate is uniform and constant around the entire perimeter of the mold throughout the casting operation.

For this purpose, the subject of the invention is a mold for the vertical hot-top continuous casting of metals, especially steel, consisting of a cooled metal body which defines a passage for the cast product and on which sits a feed head made of a refractory, and a purge slit is made at the interface between said body and said feed head, a stream of waste inert gas being injected around the internal perimeter of the mold via said slit from a plenum chamber which is made near the slit and is itself supplied with gas via inlets which connect it to a pressurized-gas supply, which mold is distinguished by the fact that the purge slit is segmented around the perimeter of the mold with the aid of separating means which also segment said plenum chamber into contiguous compartments around the perimeter of the mold and that calibrated inlets are provided at each compartment thus formed in order to connect it to the pressurized-gas supply.

As will be understood, the invention therefore essentially consists in providing a discontinuous injection slit around the perimeter of the mold with a stream of purge gas via a chamber which goes around it and is itself segmented into independent compartments around this perimeter. In this way, a plurality of autonomous injection circuits are produced from the pressurized-gas supply, these being mounted in parallel and each including: a calibrated inlet running out into a compartment extended by a purge slit supplying only one portion of the perimeter of the mold with gas, the juxtaposition of these slits along their length ensuring that gas is distributed over the entire internal perimeter of the mold.

Preferably, the slit length is the same as that of the associated compartment.

Thus, any perturbation in the gas flow in any circuit due to an external cause, for example the accidental narrowing of a purge slit, in no way influences the flow in the neighboring circuits. Overall, the injection perimeter right around the mold therefore becomes insensitive to local failures, contrary to the prior art in which a local anomaly in the purge slit may lead to degradation of the gas flow characteristics around a substantially greater part of the perimeter than that involved directly by the incident.

BRIEF DESCRIPTION OF THE DRAWINGS

The invention will be more clearly understood and other aspects and advantages will appear more clearly in light of the appended plates of drawings in which.

In the figures, the same components are denoted by identical reference numbers.

DESCRIPTION OF THE PREFERRED EMBODIMENTS

Figure 1:
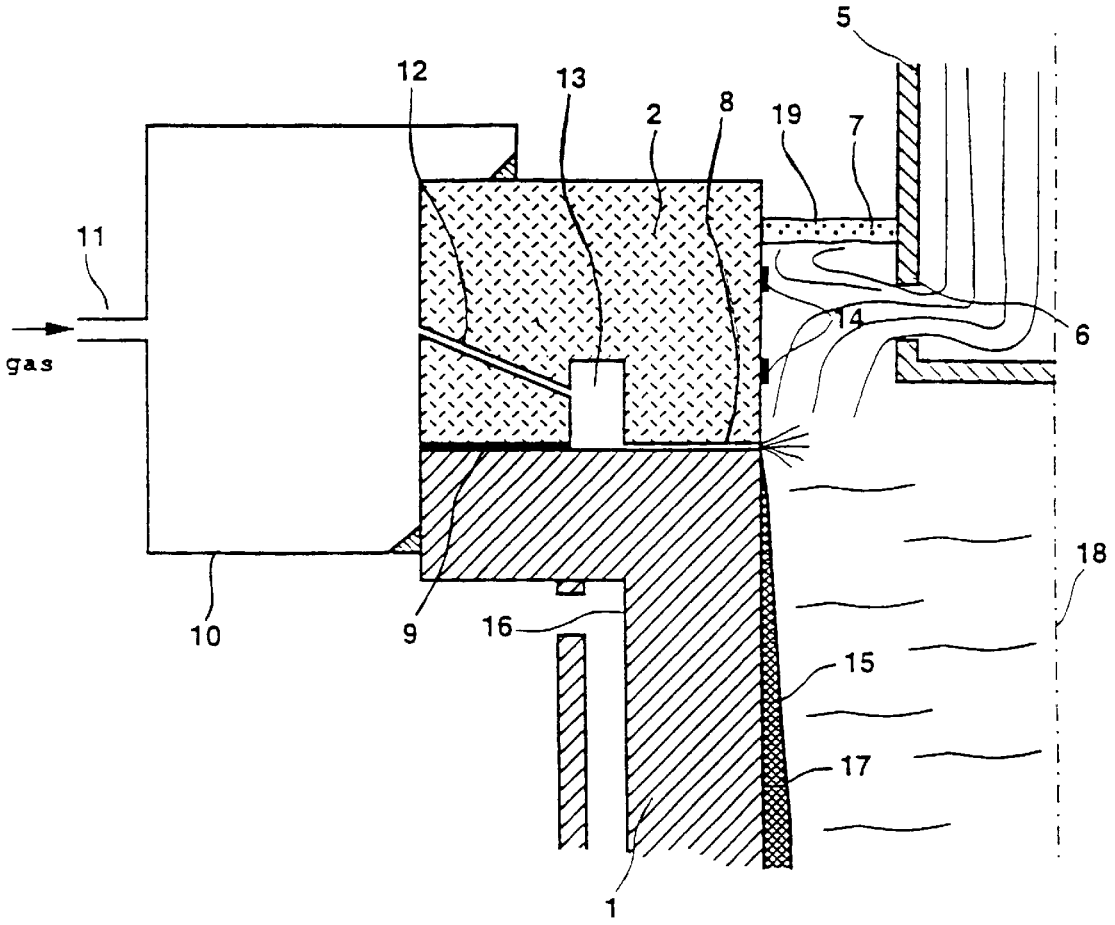
FIG. 1 (PRIOR ART)
FIG. 1 represents, in vertical section, the upper part of a vertical hot-top continuous casting mold provided with a gas-injection circuit according to the prior art already mentioned.

FIG. 1 will be briefly commented on solely in order to put the invention in its context. Those skilled in the art will be able, if they so desire, to find a more detailed description of the complete construction of a vertical hot-top continuous casting mold by referring, for example, to the documents EP-A-620,052 or FR-A-2,000,365 mentioned at the beginning.

This figure indicates, at 1, the upper part of the cooled metal body of the mold, consisting here of a tubular component made of a copper alloy and vigorously cooled by water circulation on its external face 16, while its internal face 17 defines a casting space in which molten steel 4 solidifies on contact with the cold wall 17, forming a shell 15. This shell 15 forms a casing which will grow toward the inside as the cast metal is extracted downward from the mold, this continuing until complete solidification of the product due to the effect of water spray units with which the casting machine downstream of the mold is equipped.

The molten metal is introduced into the mold, at a rate adjusted to that with which the cast metal is removed therefrom, with the aid of a refractory nozzle which runs into the bottom of a pouring tundish, not illustrated, placed above it. The nozzle is provided in its bottom part with lateral holes 6 via which the molten metal flows out into the mold. During casting, controlling the flow of "metal" allows the free surface 7 of the molten metal to be maintained at a controlled height some ten centimeters above the holes 6 (in view of the fluctuations due to the vertical oscillation of the mold).

As will be understood, this upper part of the cast metal (15–20 cm below the meniscus) is in fact a reservoir of molten metal contained, not in the copper body 16, but in a refractory feed head 2 placed on the element 16 and preferably aligned with the internal wall 17 of the latter. It is this particular feature which constitutes the main characteristic of hot-top casting according to the invention. In fact, the inevitable turbulence occurring in the volume of cast metal in the region of the outlet holes 6 is thus confined in that part of the casting space defined by the feed head. Thus, solidification of the metal against the cooled copper wall 17 starts and grows under very favorable hydrodynamic conditions since the flow of metal therein is of the "plug flow" type (no substantial velocity gradient over the cross section of the product).

However, a stream of inert purge gas (argon) is recommended over the internal perimeter of the mold just above the upper edge of the copper element where solidification starts. This purge stream allows a sharp and uniform onset of the solidification process, by breaking the spurious solidification film which may form in a random and irregular manner against the refractory wall of the feed head 2, fragments of which film are illustrated by the reference number 14.

As may be seen, this purge stream is produced by a feed circuit comprising, from a pressurized supply of argon 10, calibrated inlets 12 which connect this supply to an internal plenum chamber 13 which goes around the perimeter of the mold and emanating from which is a slit 8 emerging in the mold between the feed head 2 and the body at the center 1.

In the embodiment shown in the figure, this slit is made between the two aforementioned components by virtue of a calibrated shim 9 inserted around the periphery of the copper component 1.

Figure 2:
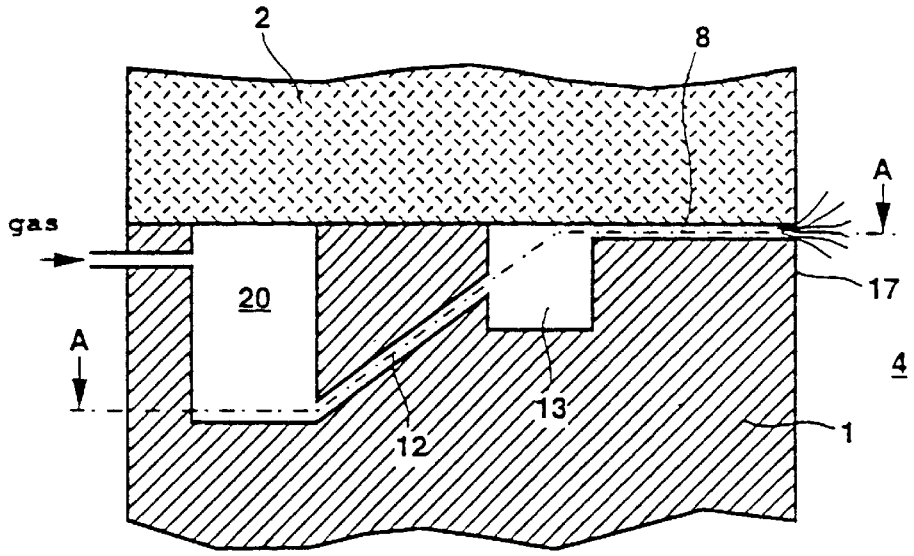
FIG. 2 represents, also in vertical section on the plane B—B' of FIG. 3, an enlarged view of the gas-injection circuit with which the upper part of a vertical hot-top continuous casting mold according to the invention is provided.
Figure 3:
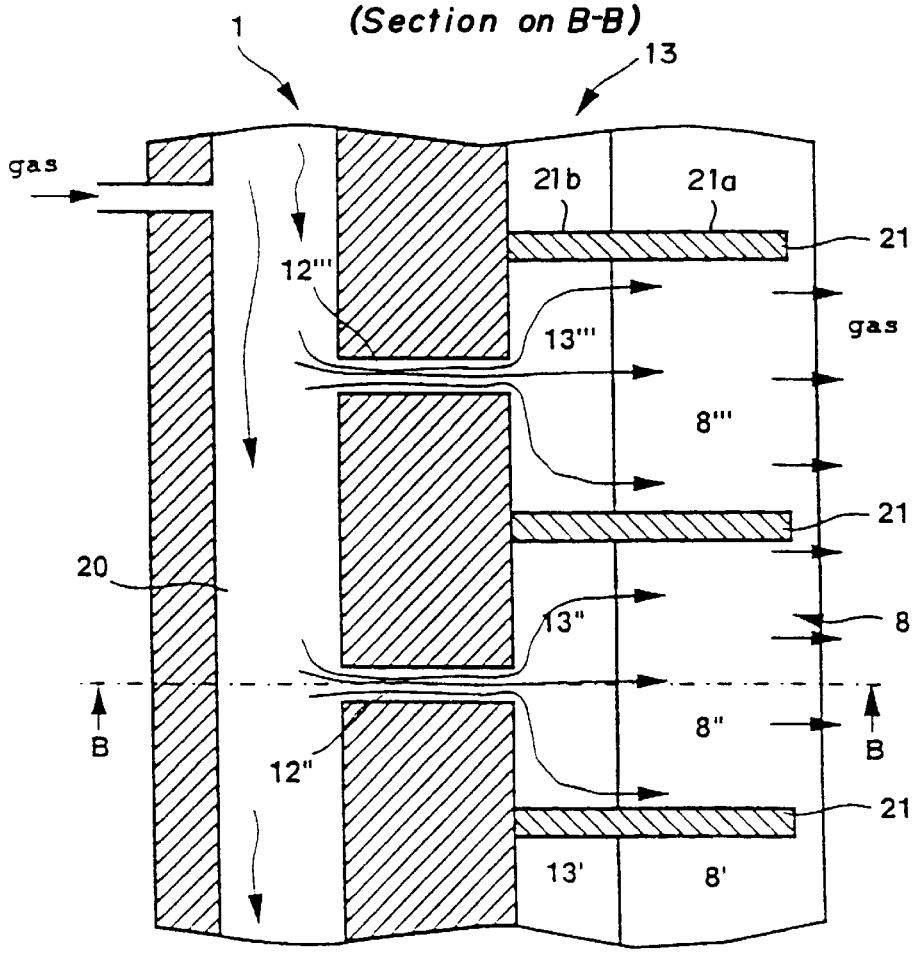
FIG. 3 represents the injection circuit seen in the cutting plane A—A' of FIG. 1.

Referring now to FIGS. 2 and 3, it may be seen that, according to the invention, the solution provided to the problems posed in the above purge circuit with respect to the uniformity of delivery of the output flow of gas around the internal perimeter of the mold consists:

in adopting a configuration comprising two chambers in cascade, and in sectorizing the second chamber into compartments which are juxtaposed around the perimeter of the mold, in the same way as the purge slit associated with this chamber.

A first chamber 20 serves to contain a volume of argon at a given pressure. The calibrated inlets 12 connect this chamber to the second chamber 13 whose function, as has been indicated, is to deliver the gas into the purge slit 8 which emerges at the internal surface 17 of the mold 1 around the perimeter of the latter.

The purge slit 8 is divided into juxtaposed sectors, separated from each other by partitions 21 which likewise divide the second plenum chamber 13 into compartments 13', 13", etc. which are juxtaposed around the perimeter of the mold and in coincidence with the position of the slit. For this purpose, each partition 21 comprises a forward part 21*a* of low height, corresponding to the thickness of the slit 8 in which it is positioned, and a parent part 21*b* whose surface corresponds to the cross section of the chamber 13 to be partitioned.

Each partition 21 is preferably a machined piece which is then attached, for example by welding, in the chamber 13 between two intakes of the calibrated inlets 12', 12".

A plurality of autonomous circuits for delivering gas into the mold is thus produced, these being mounted "in parallel" with respect to the single supply represented by the pressure chamber 20 and each composed of a compartment 13' extended downstream by a section 8' of the slit 8 and supplied via a calibrated inlet 12' tapped off from the general chamber 20. The latter is sized in order to ensure that the pressure of the gas around the perimeter of the mold is uniform. With regard to the intermediate chamber 13, its segmentation into individual compartments 13', 13", etc., each associated with a particular sector 8', 8", etc. of the slit 8, ensures that there is uniform gas injection in each individual circuit 12'- 13'- 8' thus formed.

It may be seen that the introduction of the segmentation according to the invention makes it possible for the influence of the local variations in the thickness of the slit on the overall flow of gas injected into the mold to be split up by a factor of five, or even eight. In other words, by segmenting the "downstream" part of the injection circuit according to the invention, each elementary circuit thus formed is supplied in an identical and constant manner by the general pressurized chamber 20 and the whole assembly becomes insensitive to local thickness variations in the slit or, more generally, to any localized perturbation of the injection circuit due to some cause external to the circuit.

Thus, it becomes possible to inject gas over a great mold perimeter length (several metres long) in a uniform manner throughout. This result demonstrates the advantage that may be obtained by applying the invention to the continuous casting of large-format products (slabs or blooms) in particular.

It goes without saying that the invention is not limited to the example described, but extends to many variants or equivalents as long as its definition given by the appended claims is respected.

In particular, the calibrated inlets 12 themselves may also be configured in the form of a slit.

Likewise, it is a matter of indifference whether the intermediate chamber 13 is made in the refractory feed head 2 (FIG. 1) or in the copper component 1 (FIGS. 2 and 3). Of course, it will be desirable to seal the circuits and chambers which are made in the refractory part.

With regard to the partitions 21, which divide both the slit 8 and the chamber 13, it is quite clear that any means other than that described, which fulfills this double function, will be suitable, such as plates (equivalent to 21*b*) for partitioning the chamber 13, these plates being combined with ribs (equivalent to 21*a*) made on the upper face of the copper component and combining with the refractory part above them in order to define the slits, knowing that the order of magnitude of the thickness of the purge slit may be 0.1–0.3 mm approximately.

What is claimed is:

1. An improved mold for the vertical hot-top continuous casting of metals, including a cooled metal mold body which defines a passage for cast metal and on which sits a feed head made of a refractory, and a purge slit defined between an interface between said body and said feed head, wherein a stream of waste inert gas is injected around the internal perimeter of the mold via said slit from an annular plenum chamber which communicates with said slit and is itself supplied with gas via inlets which connect it to a pressurized-gas supply, wherein the improvement comprises separating means for partitioning said plenum chamber into contiguous compartments around the perimeter of the mold, and calibrated inlets for connecting each compartment to the pressurized-gas supply such that said purge slit is segmented into a plurality of slit portions each of which is connected to a single compartment of said plenum chamber.

2. The mold as claimed in claim 1, wherein said plenum chamber is made in the cooled metal body of the mold and the separating means includes partitions which have a forward part for dividing the slit and a parent part for dividing the plenum chamber.

3. The mold as claimed in claim 1, wherein each slit portion is associated with one of said compartments and wherein a length of each slit portion is equal to that of a length of the compartment with which it is associated.

4. The mold as claimed in claim 1, wherein the calibrated inlets are also configured in the form of a slit.

5. The mold as claimed in claim 1, wherein the purge slit portions have a thickness of between 0.1 and 0.3 mm.

6. The mold as claimed in claim 1 which equips a machine for the continuous casting of steel.

* * * * *